United States Patent [19]

Davis, Jr. et al.

[11] Patent Number: 4,506,729

[45] Date of Patent: Mar. 26, 1985

[54] DRILL STRING SUB WITH SELF CLOSING CABLE PORT VALVE

[75] Inventors: Albert P. Davis, Jr., Houston; Orien M. Knight, Joshua; John W. Stoltz, Fort Worth, all of Tex.

[73] Assignees: Exxon Production Research Co., Houston; Gearhart Industries, Inc., Fort Worth, both of Tex.

[21] Appl. No.: 468,534

[22] Filed: Feb. 22, 1983

[51] Int. Cl.[3] ..... E21B 17/00; E21B 34/00

[52] U.S. Cl. ..... 166/65 M; 166/242; 174/47

[58] Field of Search ..... 166/65 R, 66, 117.5, 166/242, 65 M, 316, 332, 75 R, 77.5, 80; 175/320; 174/47

[56] References Cited

U.S. PATENT DOCUMENTS

| | | | |
|---|---|---|---|
| 2,355,342 | 8/1944 | Van Wormer | 175/104 X |
| 4,062,551 | 12/1977 | Base | 166/65 R |
| 4,099,562 | 7/1978 | Mattoon | 166/80 X |
| 4,200,297 | 4/1980 | Tricon | 166/65 R |
| 4,388,969 | 6/1983 | Marshall et al. | 166/65 R |

*Primary Examiner*—Stephen J. Novosad
*Assistant Examiner*—Michael Starinsky
*Attorney, Agent, or Firm*—Alfred A. Equitz

[57] ABSTRACT

A side-entry sub for use in conjunction with wireline cable. The sub has a cable entry port provided with a self-closing valve for sealing the port upon withdrawal of the cable. In one embodiment, the self-closing valve is characterized by a housing member supporting a closure disc which is integrally molded with a resiliently deflectable support member having an elastic memory which biases the valve in the closed position. In an alternate embodiment, the self-closing valve comprises a ball valve, biased in the closed position by magnetic or spring means, and having a passageway through which the cable may pass. When the cable is inserted through the passageway, the ball valve is held in the valve open position. When the cable is removed from the passageway, the ball valve automatically closes.

20 Claims, 12 Drawing Figures

FIG. 5
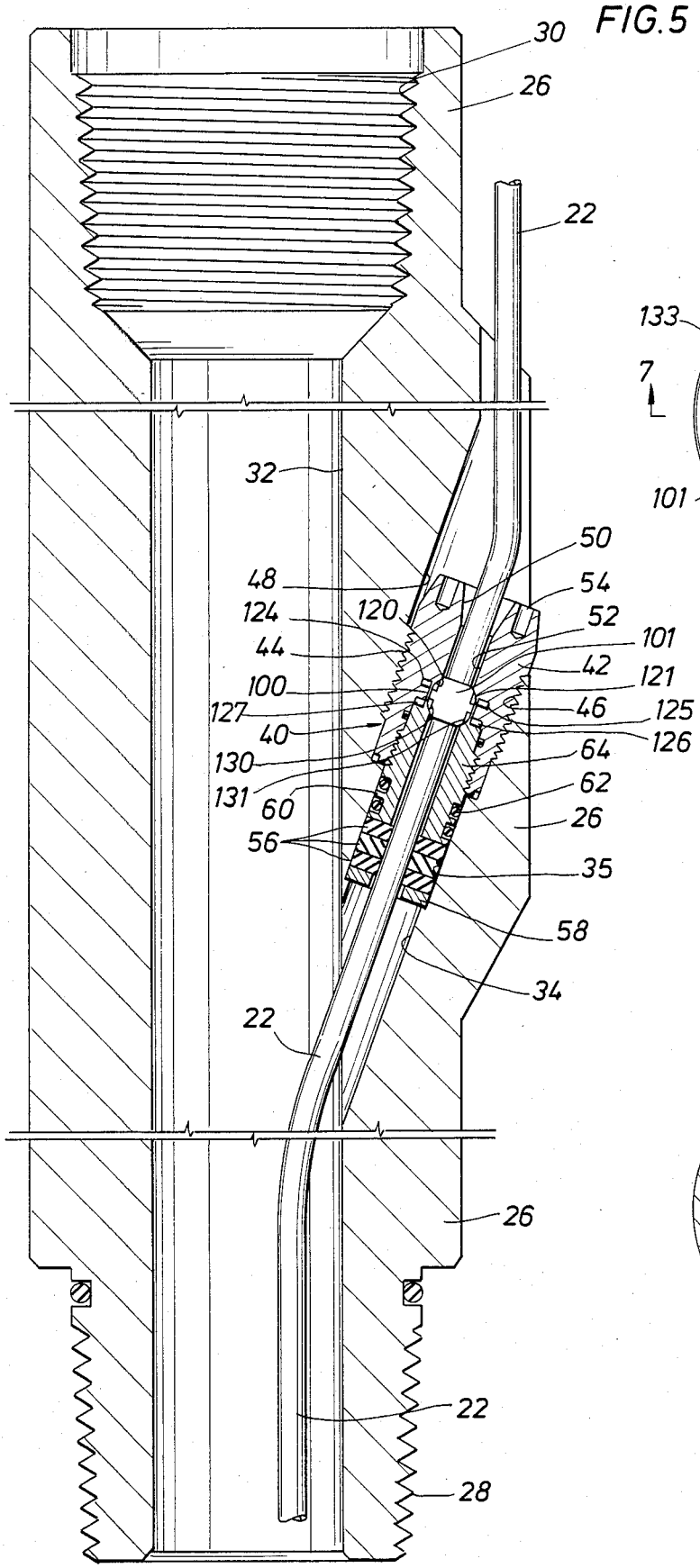
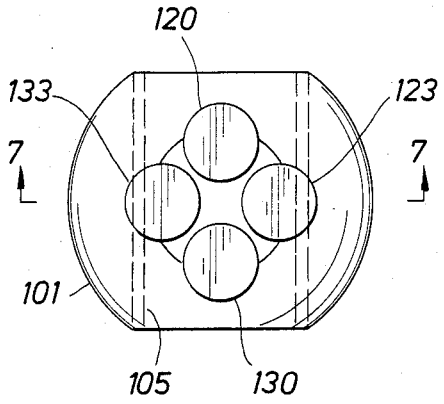
FIG. 6
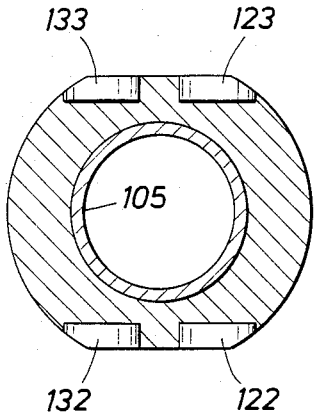
FIG. 7

FIG. 9
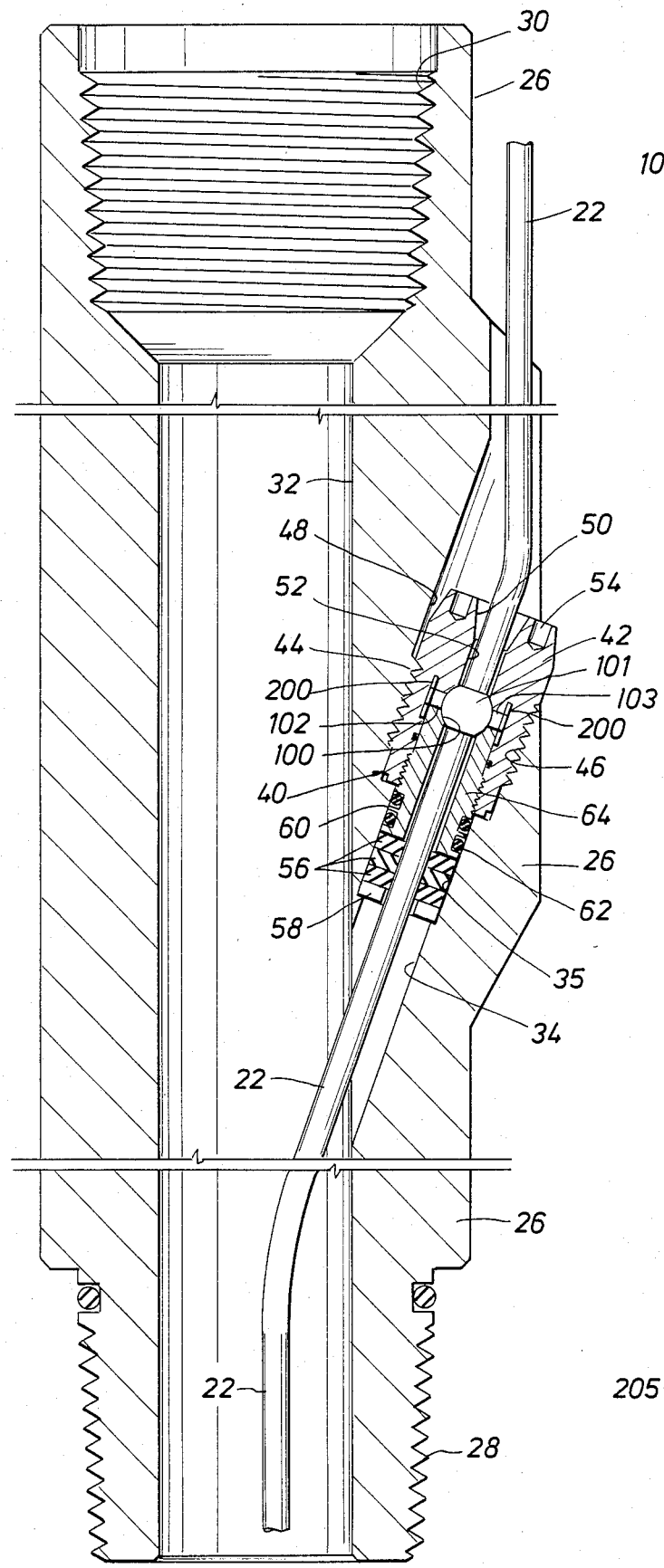
FIG. 10
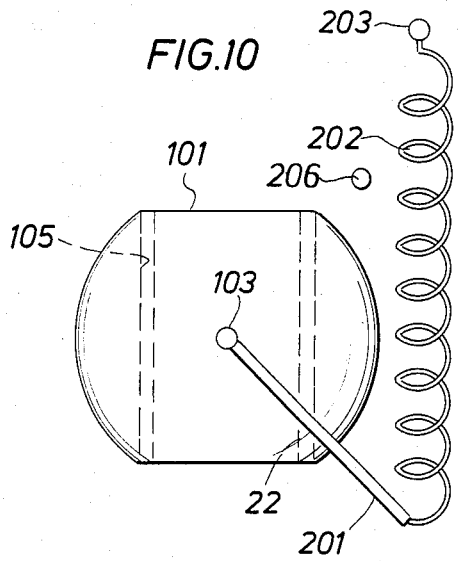
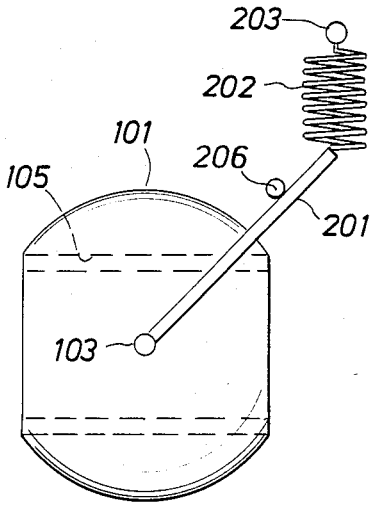
FIG. 11
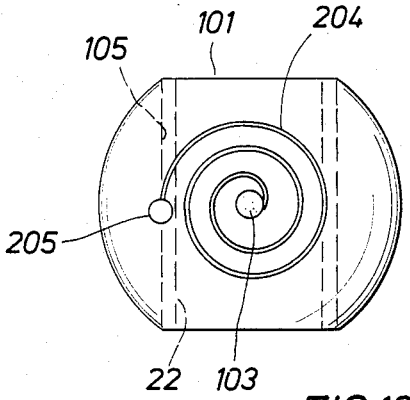
FIG. 12

DRILL STRING SUB WITH SELF CLOSING CABLE PORT VALVE

FIELD OF THE INVENTION

The present invention pertains to a drill string sub having a side-entry port for insertion and removal of a wireline cable and including a self-closing valve to seal the port upon removal of the cable from the drill string.

BACKGROUND OF THE INVENTION

The drilling of oil or gas wells commonly involves the use of an apparatus made up of a drill string having a steering tool or a plurality of logging tools positioned within or affixed to the drill string near its lower end. A communication wireline cable is often used for transmitting to the surface the information gathered by such a tool or tools.

Devices known as "mud motors" or "turbodrills" are often employed in an operation for changing the direction of a wellbore during drilling operations. These devices may be attached near the lower end of the drill string above the drill bit. During mud motor drilling operations, high pressure drilling mud is circulated down the interior of the drill string, through the mud motor and drill bit and up the annulus of the wellbore. The action of the mud on turbine blades built into the mud motor rotates the drill bit without rotating the drill string. During such mud motor drilling operations, a steering tool is often positioned inside the drill string above the mud motor. The steering tool monitors the inclination and azimuth of the wellbore during drilling, so that course corrections may continuously be made.

One common method for establishing communication with a steering or other downhole tool involves insertion of a wireline cable through a port in an element of drill string known as a "side-entry sub", to form a hardwire link between the downhole tool and the surface. Thus, a fixed length of such a cable is contained inside the drill string below the side-entry sub. The cable between the side-entry sub and the surface extends along the outside of the drill string.

One benefit of the wireline cable's side-entry through a side-entry sub stems from the fact that new drill pipe sections may be added to the drill string without first withdrawing the cable from the wellbore. In contrast, if the wireline cable is run totally inside the drill string from the surface to the downhole tool, the most feasible method for adding a pipe section to the drill string involves the complete removal of the cable from the drill string, followed by addition of the new pipe section, and re-installation of the cable. Inclusion of a side-entry sub in the drill string renders unnecessary such repeated cable re-installation, increasing the speed of the operation, and lowering its cost.

Various schemes have been proposed for sealing a cable at its point of entry through the side-entry sub. For example, U.S. Pat. No. 4,062,551 to Base and U.S. Pat. No. 4,200,297 to Tricon disclose apparatus for permitting the sealed side-entry of a cable into the interior of a drill string. Base discloses a cylindrical cable seal unit which may be fitted between adjacent pipe sections in a drill string to form a substantially continuous assembly. A port is bored through the side of the cable seal unit for passing a cable therethrough. The interior end of the port is of smaller diameter than the outer end, thus defining a shoulder. An annular packing seat is positioned in the shoulder. Packing material is compressed against the packing seat and the cable is positioned through the port to seal the port around the cable. Tricon discloses a similar apparatus for permitting the entry of a cable through a port in a housing attached to the side of a section of drill pipe by providing a seal between the cable and the housing when the cable is positioned in the port.

However, neither Base nor Tricon discloses apparatus which automatically seals the port on removal of the cable. Thus, either apparatus would permit fluid flow through the port between the interior and exterior of the drill string in the event that a cable was removed.

It may be desirable to remove the cable from the drill string during drilling or logging operations, for example, if the cable becomes damaged. Another important reason for removing the cable would be to vacate the drill pipe after it has become stuck. Retaining a length of cable inside such stuck drill pipe would severely hamper the running of tools, such as free-point indicators and explosive devices, down the interior of the drill string. Also, if the drill string must be rotated while the side-entry sub section is positioned below the surface, that portion of the cable extending along the outside of the drill string and running to the surface will probably sustain damage and could severely interfere with drill string rotation. When it is desired to remove the cable from the drill string, the cable usually is removed by retrieving it through the port in the side-entry sub section. In so removing the cable from the port, however, if the cable port is left open and drilling fluid or "mud" is being circulated, the drilling mud will short circuit the normal drilling mud flow path and instead will flow through the open cable port of the side-entry sub. The prior art has not addressed this problem. The present invention provides a solution to this problem by automatically closing the side-entry port on removal of the cable therefrom.

SUMMARY OF THE INVENTION

The present invention provides an improved side-entry "sub" (or element of drill string) suitable for use with wireline cables and the like. The invention includes a self-closing cable port valve which substantially and automatically seals the cable entry port upon withdrawal of the wireline cable from the interior of the drill string. Circulation of fluids through the drill string then may be maintained.

One embodiment of the present invention involves a side-entry drill string sub having a self-closing flapper valve associated with a wireline cable entry port. The flapper valve is mounted on a resiliently deflectable support member having an elastic memory tending to bias the flapper valve to the valve-closed position. When a cable is positioned through the port, the flapper valve is pushed by the cable into the valve-open position. Upon withdrawal of the cable from the port, the flapper valve automatically closes. The elastic memory of the support member and the pressure differential between the inside and outside of the sub (if, as is usually the case when circulating drilling mud, the inside pressure exceeds the outside pressure) tend to maintain the flapper valve in the valve-closed position. The flapper valve is mechanically uncomplicated and it is also resistant to malfunction resulting from contact with corrosive fluids or fluids in which solid particles are suspended.

Another embodiment of the invention involves a side-entry drill string sub having a rotatable ball valve, positioned in a wireline cable entry port. A passageway, dimensioned to admit a cable, extends through the ball valve. The ball valve is biased by magnetic or spring means so that it tends to rotate automatically to the valve-closed position. The ball valve is held in the valve-open position, and prevented from so rotating to the valve-closed position when a cable is positioned through the ball valve passageway.

Another embodiment of the invention involves a side-entry sub suitable for use with wireline cables and the like, having a cable port valve assembly which is adapted to provide a fluid-tight seal for the cable in the valve open position. The valve assembly is readily removable to facilitate insertion of a cable through the side-entry sub, to repair or replace a cable packing or seal, and to repair or replace the self-closing valve.

BRIEF DESCRIPTION OF THE DRAWINGS

FIG. 5 is a side elevation in central longitudinal section of a side-entry sub employing a magnetically biased ball valve.

FIG. 6 is a side elevation of the ball portion of the ball valve of FIG. 5.

FIG. 7 is a section view taken along the line 7—7 of FIG. 6.

FIG. 9 is a side elevation in central longitudinal section of a side-entry sub employing a spring-biased ball valve.

FIG. 10 is a side elevation of one embodiment of the spring-biased ball valve of FIG. 9 and is shown in the open position.

FIG. 11 is a side elevation of the spring-biased ball valve of FIG. 10, shown in the closed position.

FIG. 12 is a side elevation of an alternate embodiment of the device of FIG. 9 which uses a spiral-wound spring to bias the valve to a closed position.

DESCRIPTION OF THE PREFERRED EMBODIMENT

Figure 1:
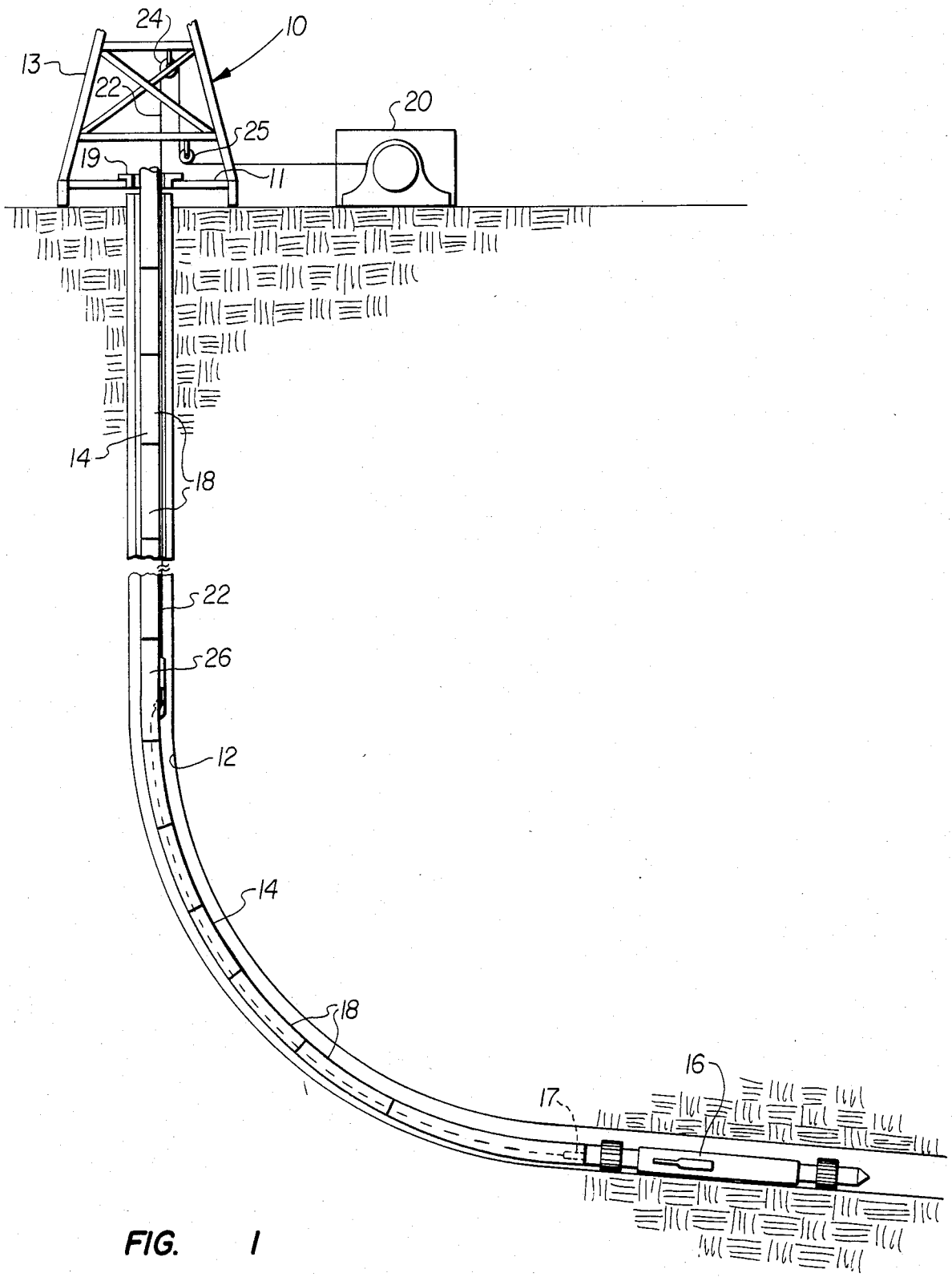
FIG. 1 is a schematic view of a deviated wellbore having a drill string therein. A wireline cable is inserted through a side-entry sub in the drill string.

In FIG. 1 a drilling rig 10 is shown above wellbore 12. The wellbore 12 is deviated at an angle away from the vertical. An elongated drill string 15 extends down into the wellbore and has logging tool 16 attached to its lower end. Drill string 14 is made up of a plurality of end-to-end connected sections 18 of pipe.

In FIG. 1, drill string 14 extends down through the floor 11 of drilling rig 10 into wellbore 12. A conventional rotary table 19 for rotating drill string 14 is shown. A power winch assembly 20 is connected to one end of an elongated flexible cable or wireline 22 and is suitable for paying out or reeling in said cable. The cable 22 passes over sheaves 24 and 25 suitably connected to drill rig 13. The wireline cable 22 extends alongside the upper portion of drill string 14 to a point below the surface. At that point the cable enters the interior of the drill string through a port formed in side-entry sub 26.

In positioning the tool 16 for performing logging operations, or other procedures in accordance with the particular type of tool being used, the tool is typically lowered to the upper portion of the zone in the wellbore to be surveyed and the side-entry sub 26 is added to the drill string. The wireline cable 22 is then inserted through a suitable port in sub 26, which will be described in further detail herein, and lowered within the interior of the drill string for connection to the tool 16 by a suitable latch or connector assembly 17. The details of the latch 17 are not part of the present invention and it will suffice to say the latch member attached to wireline cable 22 may be withdrawn with the cable through the aforementioned cable port in the side-entry sub or, alternately, the wireline cable may be provided with a weak link which will permit the cable to part at a point within the interior of the drill string when subjected to a predetermined tension force. In this way the main portion of the cable may be withdrawn from the interior of the drill string and through the side-entry sub 26. This procedure is necessary, particularly in regard to operations with drill strings in angled or deviated wellbores, since it may be necessary to rotate the drill string to unstick it or to carry out some other operation.

If the drill string is rotated with the wireline cable in place through the side-entry sub, the portion of the wireline cable extending up the wellbore between the side-entry sub and the rig floor may become entangled and limit the rotation of the drill string, or the cable may break at some point between the latch 17 and the winch 20. It is therefore desirable to withdraw the cable prior to any rotation of the drill string either by releasing the latch 17, or if the latch fails to release, by tensioning the cable with winch 20 until the cable separates at its weak link and then withdrawing it. The drill string may then be rotated without interference from an exterior cable.

One problem associated with retrieval of the wireline cable pertains to sealing of the side-entry port in the sub 26. If drilling mud or other fluids are to be circulated down through the interior of the drill string after the cable 22 is withdrawn, the open port in the side-entry sub will result in a short circuit of fluid flow from the interior of the drill string through the port in sub 26 and into annular region between the wellbore and the drill string. This short circuiting of fluid flow is usually undesirable, particularly if circulation is required for well control. The present invention provides a unique self-closing valve adapted to be used with side-entry sub 26 and which automatically closes upon withdrawal of wireline cable 22 from the sub.

Figure 2:
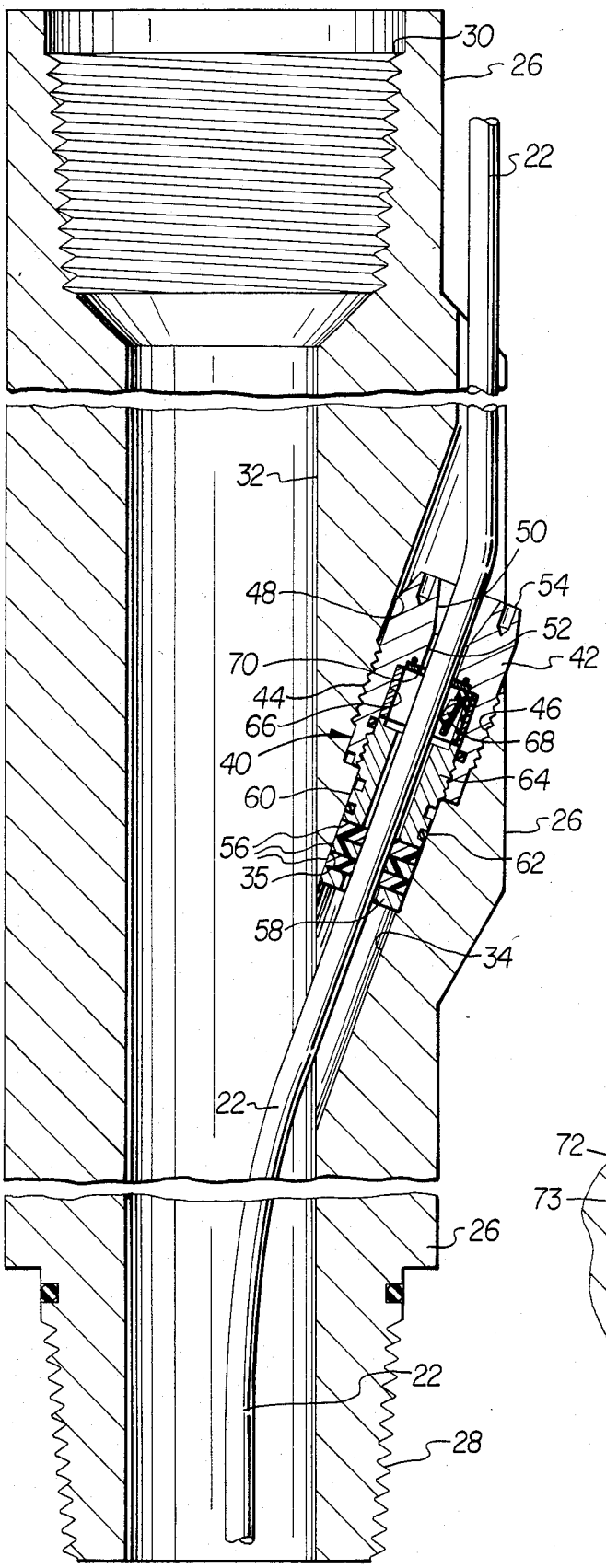
FIG. 2 is a side elevation of a portion of the sub illustrated in FIG. 1 in central longitudinal section and showing the cable inserted through the cable port.

FIG. 2 shows side-entry sub 26 in longitudinal central section view. Sub 26 includes the conventional pin and box end portions 28 and 30, respectively, suitable for inserting the sub at a predetermined point in the drill string. The sub 26 also includes a longitudinal central bore 32 which provides a passage for circulating drilling mud or other fluids used in particular operations and houses cable 22. As shown in FIG. 2, the wireline cable 22 extends from the interior passage formed by bore 32 through a side entry port 34 formed at an acute angle with respect to the longitudinal axis of the sub and along the side of the sub. The diameter of side-entry port 34 at its narrowest point desirably is significantly larger than the diameter of cable 22 to allow cable heads to be passed freely through the side-entry port and to reduce abrasive wear on the cable as it is fed through the side-entry port. Wireline cable 22 may be clamped to the side of the sub along the exterior thereof by releasable clamp means (not shown in FIG. 2 but schematically shown in FIG. 1) to provide additional support and guidance for the cable.

Side-entry sub 26 includes a unique self-closing valve which seals the cable port 34 to prevent communication between bore 32 and the exterior of sub 26. The self-closing valve assembly 40 includes a cylindrical body or housing member 42 having an externally threaded portion 44. Internal threads 46 are formed in a counterbored recess 48 of the side-entry port so that housing member 42 may be screwed into recess 48. Housing member 42 is provided with a funnel shaped inlet 50 leading to an elongated bore 52. Housing member 42 may be adapted on its exterior surface or on its end face 54 to accommodate a suitable wrench for tightening the threaded connection between housing member 42 and sub 26.

Cable entry port 34 preferably is provided with a counterbored portion 35 which forms a stuffing box and has a diameter larger than that portion of port 34 between portion 35 and bore 32. Counterbored portion 35 may receive a suitable flexible packing 56, backed by a thrust collar 58 at one end and engaged by a packing gland 60 at the opposite end. The packing gland 60 is formed as a generally cylindrical member slidably fitted in portion 35 of port 34 and including an O-ring seal 62 disposed in a suitable peripheral groove formed on the exterior of the gland. The gland 60 has an externally threaded portion 64 which may be threaded into a cooperable internally threaded bore formed in housing 42 at the end of housing 42 opposite the funnel shaped inlet 50.

Figure 3:
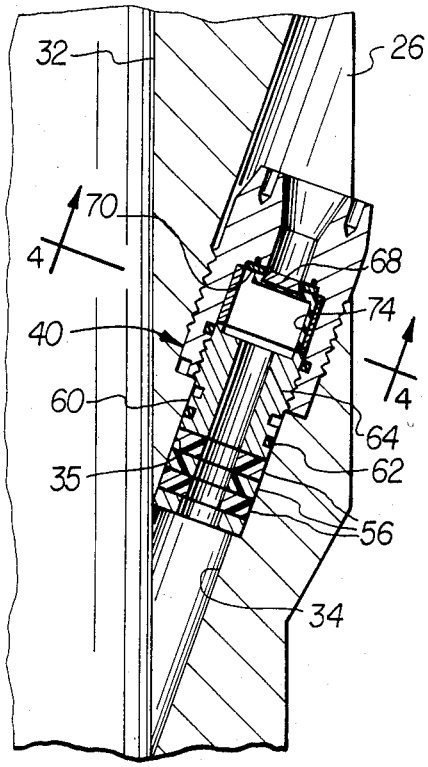
FIG. 3 is a detail section view showing the cable port valve of FIG. 2 in the closed position upon removal of the cable.
Figure 4:
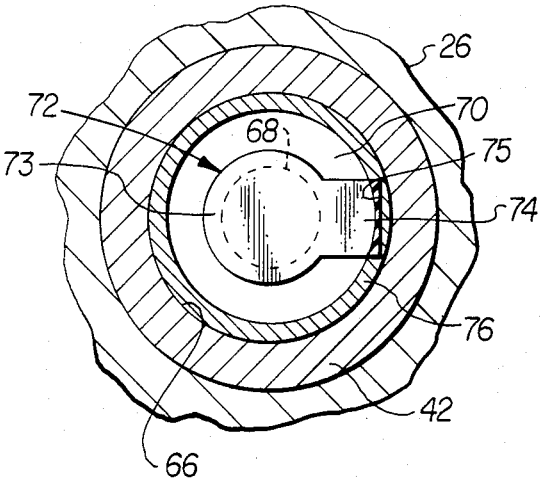
FIG. 4 is a section view taken along the line 4—4 of FIG. 3.

In the preferred embodiment, illustrated in FIGS. 2, 3, and 4, the valve housing 42 has a longitudinal central bore portion 66 forming a chamber in which flapper valve 68 is disposed. Flapper valve 68 may be moved between an open or deflected position, as shown in FIG. 2, and a closed position sealingly engaged with a seat member 70 as shown in FIGS. 3 and 4. The seat 70 may be formed as a separate disc member, as illustrated, and fitted in a counterbored portion of the housing 42, or may be formed integral with the housing 42. Flapper valve 68 is integrally molded with resiliently deflectable support member 72. Support member 72 comprises a circular disc portion 73 which is molded around flapper valve 68, and integrally formed leg portion 74, which functions as a hinge. Leg 74 is retained in slot 75 formed in support sleeve 76 which is in turn slidably disposed in close-fitting relationship with bore 66. If seat member 70 is formed as a separate disc member, as illustrated, support sleeve 76 may be dimensioned so that its inner diameter is smaller than the diameter of seat member 70 to retain seat member 70 in the counterbored portion of housing 42. Support member 72 preferably is integrally molded with flapper valve 68 and support sleeve 76 in the relative positions of the closure member and support sleeve as shown in FIG. 4. Support member 72 may be formed from a suitable elastomeric material, a preferred one of which is a neoprene composition having a hardness of 60 to 70 durometer. The flapper valve 68 may be of a hardened metallic material such as stainless steel.

By molding support member 72 together with flapper valve 68 and support sleeve 76 in the position shown in FIG. 4, the support member will bias the flapper valve in the closed position against the seat 70. However, when cable 22 is inserted through bore 52 in the valve assembly, flapper valve 68 is forced into the open position shown and rests against the side of the cable. Accordingly, upon withdrawal of the cable from the interior of sub 26 through port 34, flapper valve 68 will automatically swing into the valve-closed position, as shown in FIG. 3. In this position, there is no fluid communication between the interior and the exterior of the sub through the cable entry port. Valve assembly 40 is particularly reliable in operation since its design is quite simple. The integrally formed flapper valve and supporting structure are not subject to fouling by fluids or other debris in the wellbore and, accordingly, the valve will reliably and automatically close when the cable is withdrawn from the side-entry sub. Moreover, the construction of valve assembly 40 provides for ease of replacement of packing 56 as well as of flapper valve 68 and its supporting structure. Housing 42 may be tightened in complementary threaded bore 46 to adjust the tightness of packing 56 and thus control fluid leakage through the cable entry port when the cable is present therein.

The operation of valve assembly 40 in the embodiment shown in FIGS. 2, 3, and 4 is totally automatic and may be understood from the foregoing description. The components of the valve assembly other than those specifically described herein may be formed of suitable engineering materials such as steel for the components of the valve housing and packing gland. Packings 56 may be conventional and of the type normally used for sealing stationary or reciprocating shaft-like members. For example, a stack of split neoprene or rubber rings, the splits of which are staggered within the stack, or a strip of graphite-impregnated fiber material which is wound into counterbored portion 35 against thrust collar 58 may be suitable.

FIG. 5 is a side elevation in central longitudinal section of an alternative embodiment of the present invention. Instead of the flapper valve shown in FIGS. 2, 3, and 4, this embodiment utilizes a ball valve 101 to seal the side-entry port. Valve housing 42 is provided with a central bore portion 100 forming a chamber in which rotatable ball valve 101 is disposed. Passageway 105 (shown in FIG. 7), dimensioned to admit cable 22, extends through ball valve 101. In a first or "open" angular position of ball valve 101 (shown in FIG. 5), the cable 22 may pass through passageway 105. In a second or "closed" angular position of ball valve 101, the ball valve prevents fluid communication through port 34 between the interior of sub 26 and its exterior.

In the embodiment shown in FIG. 5, ball valve 101 is magnetically biased to rotate into the closed position and is prevented from rotating into the closed position when cable 22 is positioned in passageway 105. Thus, when the cable is removed from the passageway, the magnetic force between at least one magnet embedded in ball valve 101 and at least one magnet embedded in central bore portion 100 of the inner surface of valve housing 42 cause the ball valve to rotate automatically to the closed position.

Ball valve 101 of FIG. 5 is magnetically biased in the closed position by magnets 120, 123 (not shown in FIG. 5), 130, 133 (not shown in FIG. 5), 121, 122 (not shown in FIG. 5), 131 and 132 (not shown in FIG. 5) fixedly embedded in its surface and magnets 124, 125, 126, 127, 134 (not shown), 135 (not shown), 136 (not shown), and 137 (not shown) fixedly embedded in central bore portion 100 of the inner surface of valve housing 42. Magnets 120, 123, 130, and 133 are embedded on one side of ball valve 101 so as to define the four corners of a square. Magnets 121, 122, 131, and 132 are similarly embedded in a square configuration on the opposite side of ball valve 101. Magnets 124, 125, 126, 127, 134, 135, 136, and 137 are embedded so that when ball valve 101 is in the open position, magnet 124 is disposed opposite magnet 120, magnet 125 is opposite magnet 121, magnet 126 is opposite magnet 131, magnet 127 is opposite magnet 130, magnet 134 is opposite magnet 123, magnet 135 is disposed opposite magnet 133, magnet 136 is disposed opposite magnet 122, and magnet 137 is opposite magnet 132.

The magnets are oriented with north poles of magnets 120, 121, 124, 125, 126, 127, 130, and 131 facing outward and the south poles of magnets 122, 123, 132, 133, 134, 135, 136, and 137 facing outward. Thus, in the open position, the magnetic field due to the magnets creates a torque tending to rotate ball valve 101 by 90° to the closed position. Ball valve 101 is prevented from rotating to the closed position when cable 22 is positioned through passageway 105. The ball valve automatically rotates to the closed position on removal of the cable therefrom.

In a desired embodiment, ball valve 101 has a pair of parallel flat faces which define an axis of rotation, about which ball valve 101 may rotate, said axis of rotation being perpendicular to the axis of passageway 105. Central bore portion 100 of valve housing 42 is shaped to conform to the shape of ball valve 101, and thus has a pair of flat surfaces opposite and spaced from the flat faces of ball valve 101. The magnets embedded in ball valve 101 and in central bore portion 100 of the inner surface of valve housing 42 are flat, and are embedded, respectively, flush in the flat faces of ball valve 101 and the flat faces of central bore portion 100. The magnets are positioned in the flat faces so that in the valve-open position, the faces of each pair of opposing magnets (i.e. the pairs 124 with 120, 125 with 121, 126 with 131, 127 and 130, 134 with 123, 135 with 133, 136 with 122, and 137 with 132) are parallel and separated by as small a distance as is practicable. Such a configuration maximizes the magnetic biasing torque.

FIG. 6 is a side elevation of ball valve 101 of FIG. 5 looking toward the side on which magnets 120, 123, 130, and 133 are disposed. FIG. 7 is a section view taken along line 7—7 of FIG. 6.

In the embodiment shown in FIGS. 5, 6, and 7 ball valve 101 is magnetically biased by eight magnets embedded in the ball valve and eight magnets embedded in central bore portion 100 of the inner surface of valve housing 42. Magnetic biasing of ball valve 101 in alternate embodiments of the invention may be accomplished by embedding one or more magnets in the ball valve and one or more magnets in valve housing 42 in a configuration so that the magnetic forces between the magnet or magnets embedded in the ball valve and the magnet or magnets embedded in valve housing 42 cause the ball valve to rotate automatically to the closed position on removal of cable 22 from passageway 105.

Figure 8:
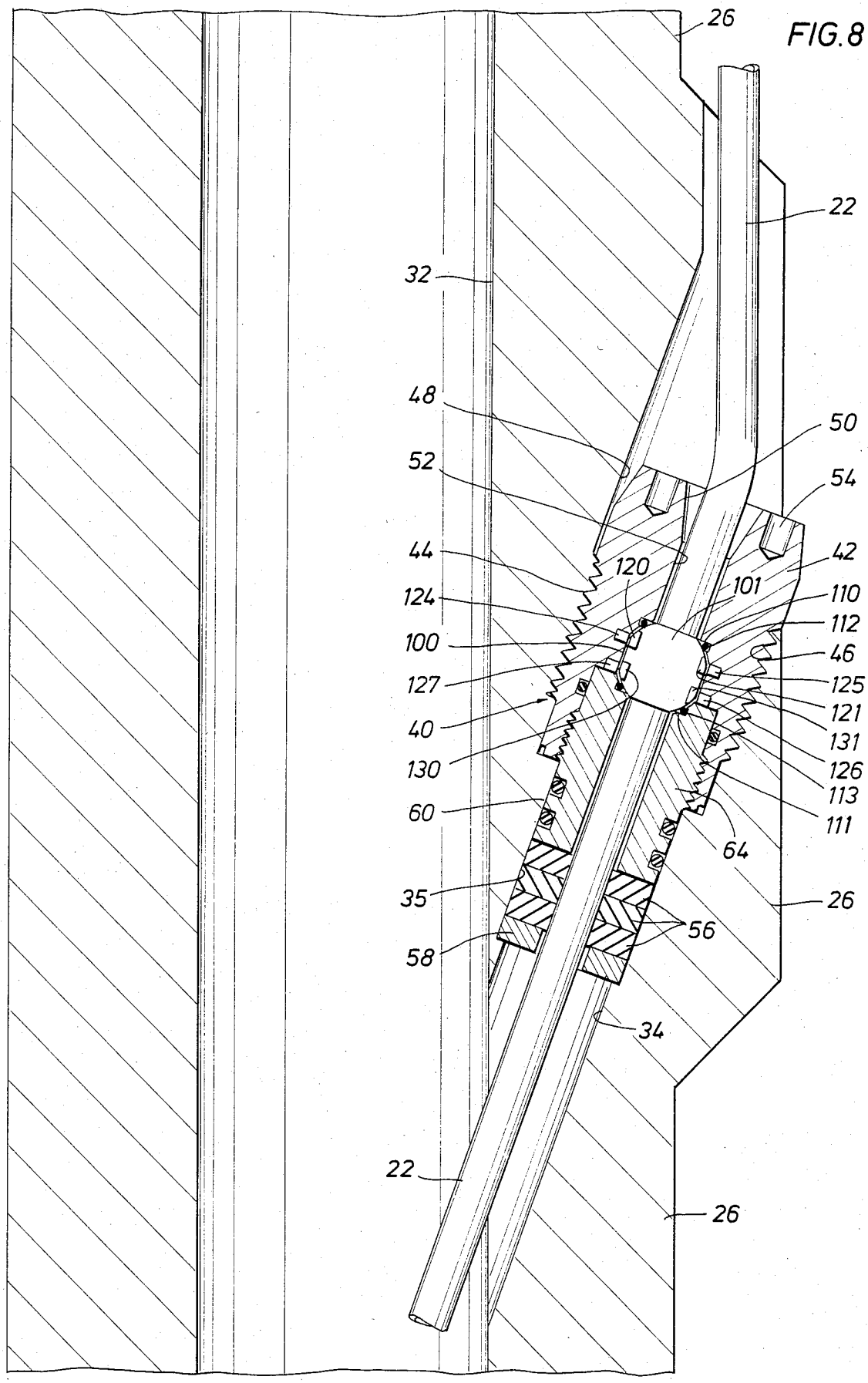
FIG. 8 is a side elevation in central longitudinal section of an alternate embodiment of the side-entry sub shown in FIG. 5, which employs a pair of O-ring seals for reducing fluid leakage around the ball valve.

FIG. 8 is a side elevation in central longitudinal section of a variation of the embodiment shown in FIG. 5. Chamber 100 is provided with two circular grooves, 110, and 111, dimensioned to admit, respectively, O-ring seals 112 and 113. O-ring seals 112 and 113 are inserted in grooves 110 and 111 to prevent fluid leakage around ball valve 101, and to reduce friction by preventing entry of particulates contained in drilling mud into the space between O-ring seals 112 and 113, ball valve 101, and housing member 42, while permitting free rotation of ball valve 101. It is preferred that the small volume bounded by the O-ring seals 112 and 113, ball valve 101, and housing member 42 be filled with a suitable grease to reduce friction further. The grease additionally prevents entry of particulates into that volume. The grease should be insoluble in water and may be selected from those well known and used in the art for similar purposes.

FIG. 9 is a side elevation in central longitudinal section of another embodiment of the present invention. It too uses a ball valve as the fluid control means. However, the ball valve is biased using one or more springs rather than a collection of magnets. Valve housing 42 is provided with a central bore portion 100 forming a chamber in which rotatable ball valve 101, including stems 102 and 103 fixedly connected to the ball valve and spring means 200 are disposed. Passageway 105 (shown in FIG. 10), is dimensioned to admit cable 22 and extends through ball valve 101. In a first or "open" angular position of ball valve 101 (shown in FIG. 9), the cable 22 may pass through passageway 105. In a second as "closed" angular position of ball valve 101, the ball valve prevents fluid communication through port 34 between the interior of sub 26 and the exterior thereof. Stems 102 and 103, fixedly connected to, and extending outward in opposite directions from ball valve 101, define the axis about which the ball valve is free to rotate.

In the embodiment shown in FIG. 9, ball valve 101 is biased by spring means 200, to rotate into the closed position. Ball valve 101 is held in the open position (and thus is prevented from automatically rotating into the closed position) by cable 22 when the cable is positioned in passageway 105.

One embodiment of spring biasing means 200 may be understood by reference to FIG. 10. FIG. 10 is a side elevation of the ball valve 101 of FIG. 9 looking toward the side from which stem 103 extends. One end of arm 201 is fixed perpendicularly to stem 103. The other end of arm 201 is connected to one end of spring 202. The other end of spring 202 is fixed at step 203 to valve housing 42 (not shown in FIG. 10). Stem 203 is fixedly connected to valve housing 42. When ball valve 101 is in the open position (as shown in FIG. 10) spring 102 exerts a torque on stem 103, and thus on ball valve 101, tending to rotate ball valve 101 counterclockwise by 90° to the closed position (shown in FIG. 11).

Stem 203 is positioned (as shown in FIGS. 10 and 11) so that spring 202 exerts a torque tending to rotate ball valve 101 counterclockwise about the axis defined by stems 102 and 103 from the open position (shown in FIG. 10) to an angular position beyond the closed position. However, once the ball valve reaches the closed position (shown in FIG. 11), peg 206, fixedly connected to valve housing 42, blocks the path of arm 201, preventing ball valve 101 from rotating counterclockwise beyond the closed position. Thus, when cable 22 is removed from passageway 105, spring 202 causes ball valve 101 automatically to rotate to the closed position. Once the ball valve has rotated to the closed position against peg 206, spring 202 maintains the ball valve in the closed position.

It should be understood that arm 201, spring 202, stem 203, and peg 204 as shown in FIG. 10, may comprise spring biasing means 200. Alternately, a second assembly identical to the assembly comprising arm 201, spring 202, and stem 203 may be associated with stem 102 on the side of ball valve 101 opposite stem 103. In this alternate embodiment, the second assembly together with the assembly comprising arm 201, spring 202, and stem 203 attached to stem 103 together comprise spring biasing means 200.

Another embodiment of spring biasing means 200 is shown in FIG. 12. FIG. 12 is a side elevation of the ball valve 101 of FIG. 9 looking toward the side from which stem 103 extends. Spiral spring 204 is attached at one end to stem 103. The other end of spiral spring 204 is attached at stem 205 to the valve housing (not shown in FIG. 12). Stem 205 is fixedly connected to the valve housing. Spiral spring 204 is selected and step 205 suitably positioned so that when ball valve 101 is in the open position, as shown in FIG. 12, spiral spring 204 exerts a torque on stem 103 and thus on ball valve 101 tending to rotate ball valve 101 by 90° to the closed position.

Central bore portion 100 of valve housing 42 is suitably dimensioned so that ball valve 202 is free to rotate about the axis defined by stems 102 and 103 only over an angular range of 90° away from the open position to the closed position. Thus, spiral spring 204 is chosen and stem 205 suitably positioned so that spiral spring 204 always exerts a torque tending to rotate ball valve 101 from the open to the closed position, but once the ball valves reaches the closed position, it is prevented by contact with valve housing 42 from further rotating.

It should be understood that spring biasing means 200 may, in one embodiment, consist of spiral spring 204 and stem 205 as shown in FIG. 12. Alternately, a second assembly, identical to the assembly comprising spiral spring 204 and stem 205, may be attached to stem 102 on the side of ball valve 101 opposite stem 103. In the alternate embodiment, the second assembly together with the assembly comprising spiral spring 204 and stem 205 attached to stem 103 together comprise spring biasing means 200.

The operation of the specific embodiments of the present invention shown in FIGS. 5 through 12 is totally automatic after ball valve 101 is rotated to the open position and cable 22 is inserted through passageway 105. Before externally threaded portion 64 of gland 60 is threaded into the complementary internally threaded bore of housing 42, ball valve 101 may be manually rotated to the valve-open position and cable 22 inserted through passageway 105, through packing gland 60 and thrust collar 58 and then into the interior of sub 26. Once the desired length of cable is threaded into the sub, thrust collar 58 is seated at the inner end of counterbored portion 35, packing 56 is placed against thrust collar 58, gland 60 is threaded into valve housing 42, and the assembly comprising gland 60 and housing 42 is threaded into counterbored recess 48 far enough to compress packing 56, causing the packing to prevent fluid communication through the annular portion of the cable entry port surrounding cable 22.

Those skilled in the art will appreciate from the foregoing description that an improved side-entry sub is provided for use in wireline operations and which includes a unique self-closing valve for sealing a cable entry port. Various substitutions and modifications to the specific embodiments of the inventive structure disclosed herein may be made without departing from the scope and spirit of the invention as recited in the appended claims.

What is claimed is:

1. A drill string sub adapted to be interposed in a drill string, comprising:

an elongated tubular member having a side wall and including a central longitudinal bore forming a passage through said sub;

a port formed in said side wall for running a flexible cable from the exterior of said sub through said port into said passage;

a housing having a channel therethrough for receiving said cable, said housing being adapted to be attached to said tubular member at said port in a manner so that said cable may be inserted through said channel into said passage; and a valve assembly attached to the housing and capable of automatically and substantially closing said channel when said cable is removed therefrom, thereby substantially preventing fluid communication between said passage and the exterior of said sub through said channel.

2. The apparatus of claim 1 wherein:

said means for closing said channel comprises a flapper valve which is engageable with said cable and yieldably biased to close said channel upon withdrawal of said cable from said channel.

3. The apparatus of claim 2 wherein said means for closing said channel further comprises:

a resiliently deflectable support member for supporting said flapper valve and for biasing said flapper valve to swing to a position closing said channel upon withdrawal of said cable from said channel.

4. The apparatus of claim 3 wherein:

said flapper valve is generally disc-shaped; and said support member comprises a disc portion attached to said flapper valve and an elongated leg portion molded integral with said disc portion, said elongated leg portion of said support member having an elastic memory for biasing said flapper valve to said closed position.

5. A drill string sub adapted to be interposed in a drill string, including:

an elongated tubular member having a side wall and including a central longitudinal bore forming a passage through said sub, said side wall having a port formed therein for running a cable from the exterior of said sub through said port into said passage;

a flapper valve which is engageable with said cable;

a housing attached to said tubular member and said flapper valve, for supporting said flapper valve, said housing including a longitudinal bore defining a channel in said port for insertion of said cable therethrough, said channel having a counterbored portion forming a stuffing box for receiving a cable packing, said housing having a threaded portion adapted to be threadedly engaged with a cooperating threaded portion formed on said sub for removably supporting said housing on said sub, said flapper valve being yieldably biased to automatically and substantially close said channel upon withdrawal of said cable from said channel, thereby substantially preventing fluid communication between said passage and the exterior of said sub through said channel.

6. The apparatus of claim 5 including:

a resiliently deflectable support member for supporting said flapper valve and for biasing said flapper valve to swing to a position closing said channel upon withdrawal of said cable from the channel;

a cylindrical support sleeve slidably disposed in said channel and having a slot for retaining said support member in said channel; and a packing gland threadedly engaged with said housing so that said packing gland extends into said stuffing box for forcibly engaging a cable packing disposed in said stuffing box.

7. The apparatus of claim 5 wherein:

said housing includes a funnel-shaped inlet to said channel for insertion of said cable in said channel.

8. A valve assembly suitable for use in a side-entry sub, said sub having a central longitudinal bore forming a central passage through said sub and having a side wall with a port therethrough for insertion of a cable through said sub from the exterior thereof to said central passage, said valve assembly comprising:

a housing having a channel therethrough for receiving said cable and including means for mounting said housing on said sub in a manner so that said cable may be inserted through said channel into said central passage; and a flapper valve disposed within said housing and biased to close said channel in said housing to prevent passage of a fluid between said central passage and the exterior of said sub, said flapper valve being held in an open position with respect to said channel in said housing by the presence of said cable in said channel.

9. The valve assembly set forth in claim 8 further comprising:

a resiliently deflectable support member for supporting said flapper valve and for biasing said flapper valve to swing from an open position when in contact with said cable to a position closing said channel upon removal of said cable.

10. The valve assembly set forth in claim 9 wherein:

said flapper valve is generally disc-shaped; and said support member comprises a generally disc-shaped element molded integral with said flapper valve and an elongated leg portion having a first and a second end, the first end molded integral with said disc-shaped element and the second end connected to said housing, said elongated leg portion having an elastic memory for biasing said flapper valve to said closed position.

11. The valve assembly set forth in claim 9, wherein said channel has a counterbored portion forming a stuffing box for receiving a cable packing, and including:

a cylindrical support sleeve slidably disposed in said channel and having a slot for retaining said support member in said channel; and a packing gland threadedly engaged with said housing so that said packing gland extends into said stuffing box for forcibly engaging a cable packing disposed in said stuffing box.

12. The valve assembly set forth in claim 9 including:

a valve seat member positioned in said housing so that said flapper valve is sealingly engaged with said valve seat member when said flapper valve is in said closed position.

13. A drill string sub comprising:

a hollow tubular member having a side wall and ends capable of being connected to a drill string so that the longitudinal axis of said tubular member is substantially coaxial with the longitudinal axis of said drill string and said tubular member forms a substantially continuous assembly with said drill string, which said tubular member includes a port extending through said side wall so that the longitudinal axis of said port intersects the longitudinal axis of said tubular member at an acute angle;

an insert member having a hollow passageway for passing a cable therethrough between the exterior and the interior of said tubular member, said insert member being attached to said tubular member at said port so that the longitudinal axis of said passageway is substantially coaxial with the longitudinal axis of said port;

sealing means for preventing fluid flow between the interior of said tubular member and the exterior of said tubular member at the connection of said insert member with said tubular member when a cable extends through said passageway; and means for automatically and substantially closing off said passageway when a cable is removed therefrom thereby substantially preventing fluid communication between the interior and exterior of said tubular member through said port.

14. The apparatus of claim 13, wherein said means for closing said passageway comprises:

a rotatable ball valve positioned in said passageway; and spring means connecting said insert member and said ball valve, said ball valve being held in an open position with respect to said passageway by the presence of said cable in passageway, and said ball valve being biased by said spring means to rotate automatically to a closed position substantially closing said passageway when said cable is removed from said passageway.

15. The apparatus of claim 14 further comprising:

a first O-ring positioned in the region of said passageway between the exterior surface of said ball valve and said insert member so that said ball valve is free to rotate; and a second O-ring positioned in said region of said passageway between the exterior surface of said ball valve and said insert member substantially parallel to said first O-ring, so that said ball valve is free to rotate and so that said first and second O-rings substantially prevent the flow of fluid through the region of said passageway between the exterior surface of said ball valve and said insert member and between said first and second O-rings.

16. The apparatus of claim 15 wherein said region of said passageway between the exterior surface of said ball valve and said insert member and between said first and second O-rings is filled with a lubricant substantially insoluble in water.

17. The apparatus of claim 13, wherein said means for closing said passageway comprises:

a rotatable ball valve positioned in said passageway;

at least one magnet fixedly mounted on said ball valve; and at least one magnet fixedly mounted on said insert member near said ball valve, said ball valve being held in an open position with respect to said passageway by the presence of said cable in said passageway, said ball valve being biased by the magnetic field due to said at least one magnet to rotate to a closed position substantially closing said passageway when said cable is removed from said passageway.

18. The apparatus of claim 17 further comprising:

a first O-ring positioned in the region of said passageway between the exterior surface of said ball valve and said insert member so that said ball valve is free to rotate; and a second O-ring positioned in said region of said passageway between the exterior surface of said ball valve and said insert member substantially parallel to said first O-ring, so that said ball valve is free to rotate and so that said first and second O-rings substantially prevent the flow of fluid through the region of said passageway between the exterior surface of said ball valve and said insert member and between said first and second O-rings.

19. The apparatus of claim 18 wherein said region of said passageway between the exterior surface of said ball valve and said insert member and between said first and second O-rings is filled with a lubricant substantially insoluble in water.

20. The apparatus of claim 13 wherein a first end of said tubular member is internally threaded and a second end of said tubular member is externally threaded so that said tubular member may be fitted between two adjacent drill string pipe sections so that said tubular member forms a substantially continuous assembly with said drill string.

* * * * *